United States Patent [19]

Gregorian et al.

[11] 4,266,976

[45] May 12, 1981

[54] FABRIC TREATING COMPOSITIONS

[75] Inventors: Razmic S. Gregorian, Aiken; Chettoor G. Namboodri, North Augusta, both of S.C.

[73] Assignee: United Merchants and Manufacturers, Inc., New York, N.Y.

[21] Appl. No.: 15,030

[22] Filed: Feb. 26, 1979

Related U.S. Application Data

[60] Continuation of Ser. No. 794,627, May 6, 1977, abandoned, which is a division of Ser. No. 584,389, Jun. 6, 1975, Pat. No. 4,118,526.

[51] Int. Cl.[3] ..... C09K 3/18

[52] U.S. Cl. ..... 106/2; 8/477; 106/15.05; 252/3; 252/8.05; 252/307

[58] Field of Search ..... 252/3, 350, 307, 8.05, 252/8.1, 608, 610; 106/2, 15.05; 8/477

[56] References Cited

U.S. PATENT DOCUMENTS

| | | | |
|---|---|---|---|
| 2,971,458 | 2/1961 | Kumins et al. | 101/170 |
| 3,677,347 | 7/1972 | Rosen et al. | 252/3 |
| 3,713,868 | 1/1973 | Gordon et al. | 427/370 |
| 3,979,219 | 9/1976 | Chang et al. | 106/271 |
| 3,990,840 | 11/1976 | von der Eltz | 8/18 R |
| 4,043,829 | 8/1977 | Ratledge et al. | 106/271 |
| 4,086,331 | 4/1978 | Neumann | 252/3 |

*Primary Examiner*—Lorenzo B. Hayes
*Attorney, Agent, or Firm*—Michael A. Caputo

[57] ABSTRACT

Foamable fabric treatment compositions are disclosed which are composed of a fabric finishing agent and a foam stabilizer, which compositions are capable of forming a foam having a blow ratio in the range from about 2:1 to 20:1 and a foam density range from about 0.5 gm/cc to 0.05 gm/cc. Methods for preparing and using the foamable compositions are disclosed.

14 Claims, 1 Drawing Figure

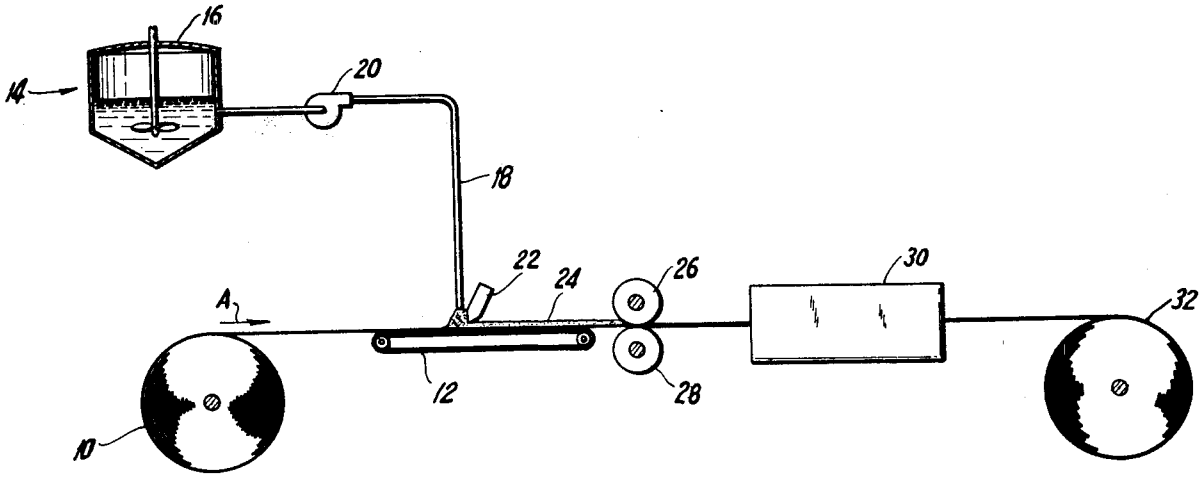
14
16
20
18
22
24
12
A
10
26
28
30
32

FABRIC TREATING COMPOSITIONS

CROSS REFERENCE TO RELATED APPLICATION

This application is a continuation of copending application Ser. No. 794,627 filed May 6, 1977 now abandoned, which application is a division of application Ser. No. 584,389 filed June 6, 1975, now U.S. Pat. No. 4,118,526.

BACKGROUND OF THE INVENTION

1. Field of the Invention

This invention relates to the field of treating textile fabrics with fabric finishing agents. More particularly, this invention relates to a novel method of application of fabric finishing agents to textile fabrics.

2. Description of the Prior Art

Conventionally, the treating of textile fabrics with finishing agents, e.g., coloring agents or dyes, resins, and the like, has always involved a procedure wherein the finishing agent is either dissolved or dispersed in a suitable liquid medium, such as, an aqueous or organic liquid, and then the mixture of the finishing agent and liquid medium are applied to the fabric. Thereafter, the carrier is removed from the fabric, usually by evaporation with or without heat. It is further conventional to use small amounts of the finishing agent, relative to the amount of liquid medium in order to conserve the amount of the finishing agent used. This results in the problem that relatively large amounts of liquid medium must be removed from the fabric. Consequently, a substantial amount of the cost incurred in such processes resides in the liquid medium removal step.

Such liquid media present a further problem in that after they are removed, they must either be disposed of or recovered for re-use. In the case of an aqueous treatment system wherein the liquid media is water, the water is normally disposed of as waste. In recent years, the environmental problems that related to the disposal of the water with residual finishing agents therein have become increasingly important.

With respect to organic solvents as the liquid medium, it is normally desirable to recover them because of their relatively high cost. Obviously, such recovery systems only add to the expense of the over all treatment process. Moreover, disposal of the solvent, if it is desired not to recover it, also prevents environmental problems.

The foregoing problems become even more severe when textile fabrics which are highly absorbent are treated. Thus, for example, when it is desired to treat or finish pile fabrics, e.g., carpeting, sliver knit fabrics, and the like, the fabrics absorb great quantities of the water or organic solvent, thus making the solvent removal step even more difficult and expensive. Additionally, because of the relatively large absorption of the liquid, the weight of the wet fabric which is being handled increases significantly, and often results in processing problems.

SUMMARY OF THE INVENTION

We have discovered a method for treating and finishing textile fabrics with fabric finishing agents which substantially reduces the problems caused by the large amount of liquid medium utilized in the conventional processes. Particularly, we have discovered that by incorporating an amount of the finishing agent which is effective to produce the desired finishing effect on the fabric, in a foamable material which is capable of forming a foam having a blow ratio in the range from about 2:1 to 20:1, the agent may be applied utilizing substantially less liquid medium than that conventionally used. Generally, the composition of the present invention contains from about 0.001 to 95 weight percent of a fabric finishing agent, and about 0.5 to 8 weight percent of a foam stabilizer, the remainder of the composition being essentially the liquid medium and other conventional additives. All weights used herein are based on the total weight of composition before foaming.

The composition is utilized by first converting it into a foam by conventional procedures, and then coating the foamed composition onto the fabric. Thereafter, the coated fabric is compressed, padded or vacuumed to assure complete penetration of the foam through the fabric and it is then subjected to a drying and any conventional curing or fixation steps desired, depending on the nature of the finishing agent.

By virtue of the use of the foamable composition of the present invention in the manner described above, the amount of liquid coated onto the fabric is substantially less, relative to the amount of finishing on the fabric. Consequently, the amount of liquid to be removed from the fabric is significantly decreased as are the problems associated with absorption of the liquid by the fabric.

BRIEF DESCRIPTION OF THE DRAWINGS

The FIGURE is a schematic diagram of a process in accordance with the present invention.

DESCRIPTION OF THE PREFERRED EMBODIMENT

Referring to the FIGURE, shown generally at 10, is a roll of fabric travelling in the direction indicated by arrow "A". The fabric is conveyed onto conveyor 12 which may be any type of conveying means conventionally used in the art, e.g., an endless conveying belt, a tenter frame, etc.

Simultaneously, in mixing tank 14, the composition in accordance with the present invention i.e., the finishing agent, foam stabilizer, and liquid diluent, i.e., organic solvent, water or dispersing liquid, is foamed by the use of mixer 16. Mixer 16 may be any type foaming device conventionally used in the art, e.g., Oakes, Godwin card, etc.

The composition, after foaming, is transferred through line 18 by pump 20 to knife 22. At this point, the foamed mixture is coated onto the fabric to produce a coated fabric designated as 24. The coated fabric then goes through nip rolls 26 and 28 which serve to compress the foamed composition and insure that it penetrates throughout the fabric. Typically, rolls 26 and 28 are of a rubber or elastomeric material. Alternately, a vacuum may be applied to the bottom side of the fabric to draw the foam through the fabric. This penetration step also destroys the bubbles of the foam and assures uniform penetration and application of the finishing agent. Thereafter, the completely impregnated fabric is conveyed through a drying and curing means which are any of those conventionally known in the art and designated as 30. The cured fabric is then wound on to take-up roll 32.

As used herein, the term "finishing agent" is intended to collectively include both coloring agents e.g., dyes, pigments and the like, color developers, e.g., acid developers for rapidogen colors, as well as agents which are used to treat fabrics to impart various properties to the fabric, e.g., water repellents, antistatic agents, weighting agents, durable press agents, soil release agents, softening agents, fire retardant agents, and the like. These finishing agents are conventionally used in the art and the particular processing conditions, e.g., temperatures, pressures, specific preferred agent concentrations, drying times, and temperatures, fixation or curing temperatures, etc., utilized with the various type finishing agents are well known to the skilled art worker.

Thus, the particular finishing agent used in the present process is not particularly important, so long as it is one which is conventionally applied to fabric using a liquid medium as described hereinabove. All of such finishing agents are susceptible to application by the present process and incorporation into the present composition.

The amount of the finishing agent used will, of course, depend on the particular finishing agent and the desired effect. It is only necessary to use an amount of the finishing agent which is effective to produce the desired result. This amount may be determined by the skilled artisan.

The present process and composition may be used to finish all types and classes of fabrics and is particularly advantageous for those fabrics which exhibit a high wet pick-up, e.g., pile fabrics, including sliver knit fabrics, carpets, flocked fabric, napped fabric, and the like, and double knit fabrics.

In the description that follows, all weight percents are based on the total weight of the composition. For dyeing purposes, the foamable composition of the present invention may be prepared by mixing from about 0.001 to 15 weight percent, and preferably from about 0.01 to 10 weight percent, of one or more coloring agents with from about 0.5 to 8 weight percent, and preferably from about 1 to 5 weight percent of a foam stabilizer, with a liquid medium, such as, water, or an organic solvent. Generally, the remainder of the mixture is the liquid medium, although other additives conventional in the art may be utilized.

As used herein, the term "coloring agent" includes dyestuffs, pigments, and other materials which are conventionally used to impart color to textile fabrics. Typically, all classes of dyestuffs may be used, e.g., dispersed dyes, cationic dyes, direct dyes, reactive dyes, acid dyes, pigments, and blends thereof.

When the particular finishing operation is a dyeing procedure, additives, e.g., dye carriers, solvents, thickeners, softeners, urea, sodium carbonate, sodium bicarbonate, and other dyeing auxiliaries and combinations of these materials may be used.

For water repellent treatments, the foamable composition may be prepared by mixing from about 2 to 15 weight percent, and preferably from about 4 to 9 weight percent of a water proofing agent and about 0.5 to 5 weight percent, preferably from 1 to 3 weight percent of a foam stabilizer with a carrier, such as, water, or an organic solvent. Here again, the remainder of the mixture is essentially the liquid medium, but other conventional ingredients, e.g., stabilizers, catalysts, softeners, resins, hand builders, thickeners, etc., may be added.

Suitable water proofing resins for use in the present invention include fluorochemical water repellants, silicone water repellants, metal complexes, waxes, and other hydrophobic agents conventionally used for rendering fabrics water repellant, e.g., fatty acid salts or polyvalent metal cations, and the like.

For antistat finishes, a foamable composition may be prepared by mixing from 0.5 to 10 weight percent and, preferably, from about 0.5 to 5 weight percent of an antistat agent and about 0.5 to 5 weight percent, preferably, from 0.5 to 3 weight percent of a foam stabilizer with a carrier such as, water or an organic solvent. Here again, the remainder of the mixture is essentially the liquid medium but other conventional ingredients, e.g., stabilizers, resins, thickeners, catalysts, softeners, hand builders, etc., may be added.

Suitable antistat agents include polyethoxy compounds, quarternary ammonium compounds, and other cationic compounds, ester compounds, poly carboxylic compounds, polyhydroxy compounds, and other anionic compounds, natural gums, starches, starch derivatives, cellulose derivatives, synthetic polymeric compounds and blends of these compounds.

For the application of weighting agents, a foamable composition may be prepared by mixing from about 0.5 to 15 weight percent, preferably, from 0.5 to 10 weight percent of a conventional weighter and from about 0.5 to 5 weight percent, preferably, from 0.5 to 3 weight percent of a foam stabilizer, with a carrier or diluent such as water or an organic solvent. Here again, the remainder of the mixture is essentially a liquid medium, but other conventional ingredients, e.g., stabilizers, resins, thickeners, catalysts, softeners, hand builders and the like may be added.

Suitable weighters include natural gums, starch, starch derivatives, cellulose derivatives, polyesters, polyoxyethylene compounds, acrylic polymer emulsions, synthetic polymeric compounds and blends of these compounds.

For durable press finishing, a foamable composition may be prepared by mixing from 10 to 60 weight percent, preferably, from about 20 to 40 weight percent of a durable press resin and from about 0.5 to 10 weight percent, preferably, from 0.5 to 5 weight percent of a foam stabilizer with a carrier such as, water or an organic solvent. Here again, the remainder of the mixture is essentially the liquid medium, but other conventional ingredients, e.g., stabilizers, catalysts, softeners, hand builders, wetting agents, thickeners, soil releasing agents, etc., may be added.

Suitable durable press resins include Dimethylol Dihydroxy Ethylene urea resins, Triazone formaldehyde resins, urea formaldehyde resins, ethylene urea formaldehyde resins, glyoxal resins, propylene urea formaldehyde resins, carbamate resins, melamine formaldehyde resins, other N-Methylol resins, N-Methylol ether resins and blends of these resins.

For application of a soil release finish, a foamable composition may be prepared by mixing from 0.5 to 15 weight percent and preferably from 0.5 to 10 weight percent of a soil release agent, and from about 0.5 to 10 weight percent, preferably from 0.5 to 5 weight percent of a foam stabilizer with a carrier such as, water or an organic solvent. If a soil release treatment is carried out in conjunction with durable press finishing, a foamable composition may be prepared by mixing from about 0.5 to 15 weight percent, preferably 0.5 to 10 weight percent, of a soil releasing agent, from about 10 to 60 weight percent, preferably from 20 to 40 weight percent, of a durable press resin and from about 0.5 to 10 weight percent, preferably 0.5 to 5 weight percent, of a foam stabilizer with a carrier such as, water or an organic solvent.

Here again, the remainder of the mixture consists essentially of the liquid medium, but other conventional ingredients, e.g., stabilizers, resins, catalysts, softeners, hand builders, wetting agents, thickeners, etc., may be added.

Suitable soil releasing agents include poly-carboxylic compounds, poly-oxyethylene compounds, polyhydroxy compounds, acrylic polymer emulsions, natural gums, resins, starches, starch derivatives, cellulose derivatives, synthetic polymeric compounds, and blends of these compounds.

For a flame retardant finish, a foamable composition may be prepared by mixing from about 5 to 95 weight percent, preferably, from 10 to 95 weight percent of a flame retardant and from about 0.5 to 8 weight percent, preferably from 0.5 to 5 weight percent, of a foam stabilizer with a carrier such as, water or an organic solvent. The remainder of the mixture is essentially the liquid medium, but conventional ingredients, e.g., stabilizers, catalysts, resins, softeners, hand builders, etc., may be added.

Suitable flame retardants include tris-dibromopropyl phosphate, tetrakis-hydroxymethyl phosphonium compounds, N-methylol phosphonamides, organo-phosphorous compounds, nitrogen compounds, phosphorous compounds, antimony compounds, bromine containing compounds, other organic and inorganic flame retardants and blends of these compounds.

As is clear from the foregoing, the specific types of finishing agents as well as the additives are conventional in the art.

Suitable foam stabilizers which can be used in the present composition include metal salts of fatty acids, e.g., potassium stearate, ammonium salts of fatty acids, e.g., ammonium stearate, sodium lauryl sulfate, coconut oil diethanol amide, disodium N-octadecyl sulfo succinamide, ethoxylated dialkyl silicones, glycol polysiloxanes, fatty acid esters, and blends of these materials.

Further stabilization of the foam may be achieved by the addition of thickeners, e.g., polyacrylic acid, copolymers of acrylic acid, polyvinyl alcohol, natural gums, starches, starch derivatives, cellulose derivatives, synthetic polymeric compounds, water soluble polymers, organic solvent soluble polymers and blends of those compounds.

Auxiliary foam stabilizers may be used in conjunction with foam stabilizers or with foam stabilizers and thickeners to obtain added foam stability. Auxiliary foam stabilizers include lauryl alcohol, sodium laurate, lower aliphatic alcohols, dodecyl alcohol, lower aliphatic acids, lauric acid, fatty acids, hydrophilic polymers, such as, agar, polyvinyl alcohol and sodium alginate and blends of these compounds.

Combinations of foam stabilizers, auxiliary foam stabilizers and thickeners can be used to give added foam stability.

Greater foam stability and optimization of the effects obtained through application of a finishing agent may also require adjustment of pH. The specific pH range required and additives useful with a particular foam stabilizer or finishing agent to obtain the desired pH are conventionally known in the art. Generally, the pH will lie in the range from about 3 to 12.

Typical liquid media which may be used include water, perchloroethylene, methanol, trichloroethylene, and other conventional solvents, e.g., chlorinated hydrocarbons and aliphatic and aromatic hydrocarbon and petroleum solvents.

Generally, the composition of the present invention is capable of being whipped into a foam having a blow ratio in the range from about 2:1 to 20:1, and preferably, from about 2:1 to 10:1. The blow ratio is determined by measuring the weight of a given volume of the foam compared to the weight of the same volume of the composition prior to foaming. The foam density range is generally from about 0.5 gm/cc. to 0.05 gm/cc. and preferably, from about 0.5 to 0.1 gm/cc.

In order to be suitable for use in the present invention, it is important that the foam be sufficiently stable so that it does not collapse between the time when the initial foaming takes place and the time when it is applied to the fabric. The blow ratios and foam densities noted above should be stable, i.e, undergo minimal change, during the period from at least about 20 minutes and up to 24 hours after formation. Consequently, not all types of foams can be used in the present invention. For example, those foams which are of the soap bubble type, do not have sufficient stability to withstand the treatment of the coating process. When foams of this type are applied to the fabric, they immediately collapse and result in spotting and non-uniform application of the finishing agent.

Moreover, such foams are not capable of being coated on to the fabric. In this respect, it is understood that when the foamed composition of the present invention is applied to the fabric, it retains its foamed shape and essentially the same degree of foaming up to the time that the coated fabric is compressed between rolls 26 and 28.

If the finishing operation is a water repellancy treatment, additives, e.g., catalysts, resins, softeners, hand builders, thickeners, extenders, and the like may be used.

It is not necessary, of course, that a pump, e.g., 20, be used to convey the foam mixture. It may be conveyed simply by gravity feed, or by simply hand feeding to the applicator.

Various methods of applying the foam coating to the fabric can be used. Preferably, a conventional mechanical knife or an air knife may be used. Alternately, the foam may be blown through a conventional jet nozzle. The important point is the fact that the stability of the foamed composition allows it to be easily coated on to the fabric without any problems arising from collapse of the foam. Consequently, after application of the foam coating to the fabric, and until the time when the coated fabric is subjected to the compression step or vacuum step, the foam maintains essentially its original form on the fabric and neither collapses nor spreads. This allows a uniform coating of coloring material, water proofing resin or other finishing agent to be applied to the material.

The amount of foam applied to the fabric depends on the particular finishing treatment being effected, the concentration of the finishing agent, the amount of agent which it is desired to add on to the fabric, etc. These add-on amounts are commonly known depending on the finishing agent used, and consequently, the amount of foam required is readily determined by the skilled art worker. The thickness of the foam coating is not critical so long as an effective amount of the finishing agent is present.

Preferably, the percentage of wet pick-up of the foam with respect to the fabric is within the range from about 8 to 85% and preferably is from about 15 to 60% by weight based on the total weight of the fabric.

The compression step may be carried out in a conventional manner, as by passing through rollers 26 or 28, or may be effected by padding or vacuuming and the like.

The pressure to which the coated fabric is subjected is not important so long as it is sufficient to insure penetration of the foamed composition throughout the fabric. Generally, padding pressures of from about 20 to 60 psi are found to be satisfactory.

After the compression step, the fabric is subjected to a drying step to remove any residual water or organic liquid. Typically, the drying step can be carried out using drying drums, loop ovens, tenter frame ovens, air ovens, infra red dryers, dielectric dryers, and the like.

Thereafter it is conventional to subject the fabric to a fixing or curing step depending on the nature of the finishing agent. Such fixing or curing steps are conventional in the art. Generally, the fixing or curing involves heating for a period of time from several seconds to a number of minutes. Typically, in a dyeing process, the fabric would be heated at temperatures in the range from about 250° to 425° F. for a time period from about 10 seconds to five minutes, preferably, from about 280° to 400° F. Alternately, fixation steps could include steaming the fabric or treatment with fixative chemicals.

When the process being carried out is a water repellancy treatment, the finish is generally cured in an oven at a temperature range of from about 250° to 600° F. for a time period from about three seconds to five minutes, preferably from about 275° to 350° F.

When the process being carried out is the application of an antistat or weighter, the fabric is generally cured in an oven at a temperature range of from about 250°–450° F. for a time period from about 3 seconds to three minutes, preferably from about 275°–300° F.

When the process being carried out is the application of a durable press, soil release, or flame retardant finish, the fabric is cured at a temperture in the range from about 250°–425° F. for a time period from about 10 seconds to 10 minutes, preferably from about 275°–380° F.

After the fixation or curing treatment, the fabric may be subjected to conventional after treatments, e.g., rinsing, oxidation, etc., and then wound up for subsequent use.

The following examples illustrate the present invention:

EXAMPLE 1

Dyeing a Polyester Knit

A 100% polyester sliver knit fabric containing 75% pile and 25% backing by weight was dyed using a dispersed dye in a foam medium.

The dye composition was prepared by mixing 79.23% water; 1.92% Resolin Brilliant yellow 7GL, (Color Index generic name: disperse yellow 93); 8.65% of an acrylic polymer emulsion having 28 percent solids (Acrysol ASE-60-Rohm & Hass); 0.576% of a 28% solution of ammonium hydroxide; 4.81% of a butyl benzoate solvent (Cindye DAC-888-Cindet Chemical Co.) and 4.81% of ammonium stearate (33% solution).

The initial viscosity of the mixture was 2450 cps (#4 spindle at 20 rpm-room temperature) and the pH was 9.8.

The composition was mixed and foamed in a kitchen type mixer (Hobart "Kitchenaid") using a wire whip blade until the blow ratio was 2.5:1. The foam containing the disperse dye was knife-coated on to the pile portion of a polyester sliver knit in a thickness of 200 mils. Thereafter, the coated fabric was passed through roller pads at a pressure of 30 psi.

The sliver knit was attached to a pin frame and dried at 250° F. for 4 minutes and then subjected to a dye fixation treatment at 350° F. for 90 seconds.

Uniform dyeing was obtained in the pile portion of the polyester sliver knit fabric. The wet pick-up was calculated from the weight of fabric before and after the foam application. The wet pick-up using the foamed composition was 46.4%. In contrast, the wet pick-up of the sliver knit fabric when dipped in water was 136.5%, 243.4% in perchloroethylene and 181.8% in an emulsion of perchloroethylene and water.

EXAMPLE 2

Water Repellent Finish

A composition was prepared by mixing 86.45% water, 5% of a commercial fluoro chemical water repellent finish (Scotchguard FC-210), 3% Acrysol ASE-60, 2% of a methylated trimethylol melamine resin (80% solids), 0.05% ammonium chloride, 0.5% ammonium hydroxide, and 3% ammonium stearate (33% solution). The pH of the mixture was adjusted to 9.5–10 with ammonium hydroxide prior to adding the ammonium stearate.

This composition was then foamed using an Oakes foamer to a blow ratio of 5:1 and knife coated on to a sliver knit fabric composed of 70% acrylic pile and a 30% polyester knitted backing. the depth of the coating was 300 mils. Thereafter, the coated fabric was padded at 30 psi. with a wet pick-up of 43% to 47%. The fabric was dried at 300° F. for 2 minutes and cured for 2 minutes at 325° F. The resulting fabric was water repellent before and after dry cleaning and possessed an acceptable aesthetic hand.

EXAMPLE 3

A composition was prepared by mixing 78.5% water, 9% of a methyl hydrogen silicone polymer (Drival FL-405), 3% acrysol ASE-60, 3% of a methylated trimethylol melamine resin (80% solids), 3% Valcat FL-403 (a catalyst for the silicone polymer), 0.5% ammonium hydroxide, and 3% ammonium stearate (33%). The pH of the mixture was adjusted to 9.5–10 with ammonium hydroxide prior to adding the ammonium stearate.

Thereafter, the composition was foamed using a planetary mixer equipped with wire whips to a blow ratio of 5:1, and knife coated on to an acrylic pile fabric in a thickness of 300 mils. Thereafter, the coated fabric was padded at 30 psi. to produce a final wet pick-up of 38–42%, dried at 300° F. for 2 minutes and cured for 2 minutes at 325° F. The resulting finish was water repellent, possessed durability to dry cleaning and possessed an acceptable aesthetic hand.

EXAMPLE 4

Water Repellent Finish

A foamable composition was prepared by mixing 85.9 parts water, 4 parts Acrysol ASE-60, 2 parts of a methylated trimethylol melamine resin (80% solids), 0.1 parts ammonium chloride, 3 parts Unamide N-72-3 (a coconut alkanol amide from Lonza Chemical Company) and 5 parts of a commercial water repellent (Scotchguard FC-210). The pH was 6.7, and the viscosity was 600 cps. (No. 4 spindle at 20 rpm-room temperature).

The solution was foamed to a 4:1 blow ratio and knife coated on to two samples of an acrylic sliver knit pile having a 70% acrylic pile and a 30% polyester backing at a coating thickness of 50 mils and 25 mils, respectively. The samples were padded at 30 psi. and the wet pick-up was calculated to be 44–77%. The samples were dried at 225° F., for 5 to 7 minutes and cured to 15 minutes at 275° F. The finished samples were water repellent and the finish was found to be durable to dry cleaning.

EXAMPLE 5

Antistat Finish on Polyester Double Knit

A foamable composition was prepared by mixing 90.9 parts water, 1.5 parts Valstat E (commercial anionic antistat from Valchem), 4 parts Acrysol ASE-60, 0.1 part of sodium oleyl sulfate emulsifier (26% solids Sipex OS-Alcolac Inc.), 0.5 part ammonium hydroxide (to pH 9–10) and 3 parts ammonium stearate (33% solution). The final pH was 9.9.

The composition was foamed to a 4:1 blow ratio and was knife coated on two samples of polyester double knit at 50 mils. The samples were padded at 30 psi. and average wet-pick up was calculated as 63%. The samples were then dried and cured in one stage at 325° F. for 2 minutes to yield a fabric having an antistatic finish.

EXAMPLE 6

Foam Method of Application of Weighters to Polyester Double Knits

A foamable composition was prepared by mixing 88.4 parts water, 4 parts of an aqueous solution of 10% shopal gum, a starch derivative, 4 parts Acrysol ASE-60, 0.1 parts ammonium chloride, 0.5 parts ammonium hydroxide (to pH 9.5–10) and 3 parts ammonium stearate (33% solution). The final pH was 9.7 and the viscosity was 1800 cps. (No. 4 spindle, 20 rpm, at room temperature).

The composition was foamed to a 5:1 blow ratio and was knife coated at 50 mils on to a polyester double knit sample. The sample was padded at 30 psi. and wet pick-up was calculated to be 60%. The sample was dried and cured in one stage at 340° F. for 2 minutes.

The sample showed a weight gain of 1.03% and possessed a satisfactory hand.

EXAMPLE 7

Foam Durable Press Finishing on 100% Cotton Twill

A foamable durable press resin composition was prepared by mixing 49 parts water, 40 parts Valrez H-17 (dihydroxy dimethylol ethylene urea resin from Valchem), 0.5 parts ammonium chloride, 5 parts Acrysol ASE-60, 0.5 parts ammonium hydroxide (to pH 9–10) and 5 parts ammonium stearate (33%). The final pH range was 9–10.

The composition was foamed to a blow ratio of 3:1. The foam was knife coated on to a 100% cotton twill at a thickness of 50 mils and was padded at 30 psi. The wet pick-ups were calculated to be 59–61%. The samples were dried at 225° F. for 4 minutes, steam pressed at 5–10–5 cycles and cured at 330° F. for 3 minutes.

The finished samples of cotton twills possessed good resistance to wrinkling which was retained after repeated home launderings.

EXAMPLE 8

Foam Durable Press Finishing on 65/35 Polyester/Cotton Blend Fabrics

A foamable durable press resin composition was prepared by mixing 57.9 parts water, 25 parts Valrez H-17, 0.5 ammonium chloride, 4 parts of a polyethylene softening agent (20% solids); 0.1 part Valdet 4016 (a wetting agent from Valchem), 2 parts of an acrylic polymer emulsion which is a hand improving agent (Valbond-6021 from Valchem), 5 parts Acrysol ASE-60 (the pH of mix at this point was 4.7), 0.5 parts ammonium hydroxide (pH adjusted to 9.5–10) and 5 parts potassium stearate (15% solution). The final pH range was 9.5–10.

The composition was foamed to a blow ratio of 4:1 and knife coated at 50 mils on to samples of a 65/35 polyester/cotton blend, which was then padded at 30 psi. and the wet pickup was calculated to be 67%.

The samples were dried at 220° F. for 3 minutes, pressed using a standard durable press pressing cycle at 325° F. composed of 5 seconds of steam, 10 seconds of pressing and 5 seconds of vacuum to produce creases in the fabric. The fabric was then cured for 3 minutes at 330° F.

The finished samples of the 65/35 polyester/cotton blend possessed wrinkle resistant properties which were durable to repeated home laundering.

EXAMPLE 9

Foam Soil Release Finish on 65/35 Polyester/Cotton Blends

A foamable durable press resin formulation was prepared by mixing 56.9 parts water, 25 parts of a durable press resin (dimethylol dihydroxy ethylene urea-46% solids), 8 parts Valbond S-50 (a commercial soil releasing agent), 4 parts of a textile softener (Valsof SR-2), 0.1% of a wetting agent (Valdet-4016), 0.5 parts ammonium chloride (pH was checked at this stage was 4.0), 0.5 parts ammonium hydroxide (pH adjusted to 9.5–10) and 5 parts ammonium stearate (33% solution). The final pH was 9.8 and the viscosity was 80 cps. (No. 4 spindle, 20 rpm, at room temperature).

The composition was foamed to a 4:1 blow ratio, knife coated at a thickness of 50 mils on to a sample of a 65/35 polyester/cotton blend and padded at 30 psi. The average wet pick-up was 69%. The samples were dried at 220° F. for 3 minutes and cured at 330° F. for 3 minutes.

The finished 65/35 polyester/cotton blend possessed soil releasing properties durable to home laundering.

EXAMPLE 10

Foam Application of a Water Repellent Finish on an Acrylic Sliver Knit Fabric A foamable composition was prepared by mixing 86.4 parts water, 3 parts Acrysol ASE-60, 2 parts of a methylated trimethylol melamine resin (80% solids), 0.5 parts ammonium hydroxide, 3 parts potassium stearate (15% solution), 5 parts Scotchguard FC-210 and 0.1 part ammonium chloride. The final pH was adjusted to 9.5–10 with ammonium hydroxide.

The composition was foamed to a 4:1 blow ratio and was knife coated at a thickness of 50 mils on the pile of an acrylic sliver knit composed of 70% acrylic pile and 30% knitted polyester backing. The sample was padded at 30 psi. and the wet pick up was calculated as being 47.2%. The sample was dried at 225° F. for 7 minutes and cured at 275° F. for 15 minutes.

The finished acrylic pile gave good initial water repellancy which was durable to drycleaning.

EXAMPLE 11

Twenty parts tris-(dibromopropyl) phosphate 62% emulsion, by weight, was added to 80 parts of an aqueous foamable composition containing 8 parts Acrysol ASE-60; 0.5 parts ammonium hydroxide; 3 parts potassium stearate (15%) and 5 parts ammonium stearate (33%). The pH was adjusted to 9.5–10 with ammonium hydroxide.

The composition was foamed to a 4:1 blow ratio and was knife coated on to a polyester sliver knit pile (25 mils above pile). The sliver knit was padded at 30 psi and the wet pick-up was calculated as being 36%. The sample was then dried at 220° F. and thermosoled at 350° F. for 90 seconds.

The finished polyester sliver knit was subjected to a match test and the methenamine carpet flammability test and passed both tests. The pile of the fabric possessed a soft hand.

EXAMPLE 12

A foamable composition was prepared by mixing 67.5 parts water, 4 parts Acrysol ASE-60, 0.5 parts ammonium hydroxide, 3 parts ammonium stearate (33%) and 25 parts tris-(dibromopropyl) phosphate (62% emulsion). The pH was adjusted to 9.5–10 with ammonium hydroxide.

The composition was foamed to a 4:1 blow ratio and was knife coated to a thickness of 50 mils above the pile of a polyester sliver knit fabric. The fabric was padded at 30 psi. and the wet pick-up was calculated as 45%–50%. The samples were then dried at 220° F. and thermosoled at 350° F. for 90 seconds.

The finished polyester sliver knit pile was subjected to the methenamine carpet flammability test and passed the test.

EXAMPLE 13

Foam Flame Retardant Finishing of Cotton with N-Methylol Dialkyl Phosphono Propionamide A foamable composition was prepared by mixing 44.5 parts water, 1 part urea, 40 parts Pyrovatex-CP (N-Methylol dialkyl phosphono propionamide, 80% solution from Ciba-Geigy), 10 parts of trimethylol melamine resin, 0.5 parts ammonium chloride and 4 parts Unamide N-72-3 (Coconut alkanolamine from Lonza Chemical Co.). The pH was 5.8 and viscosity was 10 cps (No. 4 spindle, 20 rpm at room temperature).

The composition was foamed to a 4:1 blow ratio and was knife coated on cotton flannel samples at 50 mils thickness and padded at 30 psi. (The wet pick-up was 74%.) The sample was then dried at 225° F. for 3 minutes and cured for 3 minutes at 325° F. The finished cotton flannel samples were tested for fire retardancy by the vertical char test method and passed the test.

EXAMPLE 14

Foam THPC-Urea Precondensate Flame Retardant Application on Cotton Flannel

A foamable composition containing 95 parts of a precondensate (based on 65 parts Tetrakis hydroxy methyl phosphonium chloride (THPC), and 8 parts urea), 1.5 parts sodium acetate (as a buffer) and 3.5 parts Unamide N-72-3 was prepared. The pH was 4.1 and viscosity was 27.5 cps. (No. 4 spindle, 20 rpm at room temperature).

The composition was foamed to 11:1 blow ratio, applied on cotton flannel by knife coating at 50 mils thickness and the fabric was padded at 30 psi. The wet pick-up was calculated as 51.4%. At this wet pick-up, the weight add on of precondensate was calculated as 35.64 percent (31.6% THPC and 4.04% urea) and the moisture level on the fabric was 13 percent. The moisture level was found adequate for direct ammoniation for the fixation of the fire retardant without pre-drying. The fabric after padding was directly subjected to gaseous ammonia exposure for 5 minutes at room temperature and the fire retardant on the fabric was oxidized with alkaline sodium perborate. The fabric was then rinsed and dried. The cotton flannel treated this way gave a vertical char length of 4–4.5" and was flame retardant.

EXAMPLE 15

Dyeing Acrylic Sliver Knit with Cationic Dye

A foamable composition containing a cationic dye was prepared by mixing 81.5 parts water, 2 parts Astrazon Brill Red 4G, Color Index generic name: Basic Red 14, 8 parts Acrysol ASE-60, 0.5 parts ammonium hydroxide, 3 parts potassium stearate (15% solution) and 5 parts ammonium stearate (33% solution). The pH was 9.7 and viscosity 2060 cps. (No. 4 spindle, 20 rpm at room temperature).

The composition was air whipped in a mixer to a blow ratio of 5:1 and the foam was knife coated on the acrylic pile of a sliver knit having 70% acrylic pile and 30% polyester knitted backing. The sliver knit was padded at 30 psi. and the wet pick-up was calculated as 30.3 percent. The sample was then dried and steamed under pressure at a temperature of 240° F. for 20 minutes. The cationic dye was fixed on the acrylic pile. A portion of the sample was rinsed in perchloroethylene and was found to be fast to an after rinse. A uniform bright red shade was obtained on the acrylic pile.

EXAMPLE 16

Foam Composition in Methanol for Dyeing

A foamable composition containing 54.3 parts methanol, 27.2 parts water, 2 parts Resolin Brilliant Yellow 7 GL Color Index generic name: Disperse yellow 93, 8 parts Acrysol ASE-60, 0.5 parts ammonium hydroxide, 3 parts potassium stearate (15% solution) and 5 parts ammonium stearate (33% solution) was prepared. It had a pH of 9.5–10 and a viscosity of 4200 cps. (No. 4 spindle, 20 rpm at room temperature).

The composition was foamed in a kitchen mixer to a 3:1 blow ratio and was knife coated on the 100% polyester sliver knit sample at a 50 mils thickness above the pile. The sliver knit was then padded at 30 psi. (wet pick-up was 68%) and dried at 220° F. for 4 minutes. The sample was then thermosoled in an air oven at 350° F. for 90 seconds for the fixation of the disperse dye. The polyester pile was dyed uniformly by this method.

EXAMPLE 17

Simultaneous Dyeing and Water Repellent Finishing in Foam Medium

A foamable composition containing 84.4 parts water, 5 parts Acrysol ASE-60, 2 parts Resolin Blue F.R. Color Index generic name: Disperse Blue 154, 5 parts Scotchguard FC-210, 0.5 parts ammonium hydroxide, 0.1 parts Sipex OS and 3 parts ammonium stearate (33% solution). The pH was 10.3 and the viscosity was 440 cps. (No. 4 spindle, 20 rpm at room temperature).

The composition was foamed to a 3:1 blow ratio in a mixer, and the foam was knife coated onto a polyester sliver knit pile and then padded at 30 psi. The wet pick-up was calculated as 49.3%. The sample was then dried at 225° F. for 4 minutes and was thermosoled at 350° F. for 90 seconds. The resulting fabric pile was dyed and was water repellent. Thus simultaneous dyeing and water repellent finishing was accomplished by the foam method.

EXAMPLE 18

Simultaneous Flame Retardant and Water Repellent Finishing by Foam Method

A foamable composition containing water repellant and flame retardant was prepared as follows. To 80 parts of a composition containing 3 parts Acrysol ASE-60, 2 parts of a methylated trimethylol melamine resin (80% solids), 3 parts ammonium stearate (33% solution), 0.5 parts ammonium hydroxide, 5 parts Scotchguard FC-210 and 86.5 parts water; 20 parts of Apex flame proof-567 (Tris-dibromopropyl phosphate, a 62% active emulsion) were added. The pH was adjusted to 9.5–10 with ammonium hydroxide.

The composition was foamed to 4:1 blow ratio and was knife coated onto a polyester sliver knit pile at 50 mils and padded at 30 psi. (wet pick-up was 48%). The sample was dried at 220° F. for 5 minutes and was thermosoled at 350° F. for 90 seconds.

The polyester pile passed the methanamine carpet flammability test and was water repellent.

EXAMPLE 19

Foam Dyeing in an Organic Solvent

A foamable composition containing 51 parts Varsol #2, (a hydrocarbon solvent), 0.5 parts Resolin Brilliant Yellow 7 GL, 40 parts water, 0.5 parts Sipex OS, 4 parts Acrysol ASE-60, 0.5 parts ammonium hydroxide and 3.5% ammonium stearate (33%) was prepared. The pH was adjusted to 9.5–10 with ammonia prior to the Varsol addition.

The composition was foamed to a blow ratio of 3.5:1 in a kitchen mixer and a 50 mils height of foam was knife coated on to the pile of a polyester sliver knit sample. The sample was then padded at 30 psi. and the wet pick-up was calculated as 73%. The polyester sliver knit sample was then dried at 220° F. for 4 minutes and thermosoled at 350° F. for 90 seconds. The polyester pile dyed uniformly.

EXAMPLE 20

Foam Dyeing in Perchloroethylene

A foamable composition containing 51 parts perchloroethylene, 0.5 parts Resolin Brilliant Yellow 7 GL, 40 parts water, 0.5 parts Sipex OS, 4 parts Acrysol ASE-60, 0.5 parts ammonium hydroxide and 3.5 parts ammonium stearate (33%) was prepared. The pH was adjusted to 9.5–10 with ammonia prior to the perchloroethylene addition.

The composition was foamed to a blow ratio of 3:1 in a kitchen mixer and 25 mils height of foam was knife coated on to the pile of a polyester sliver knit. The sample was then padded at 30 psi. and the wet pick-up was calculated as 84%. The polyester sliver knit sample was then dried at 220° F. for 4 minutes and thermosoled at 350° F. for 90 seconds. The polyester pile dyed uniformly.

EXAMPLE 21

Foam Dyeing with Vacuum

To correct the shade on a polyester leisure twill fabric from a light brown shade to a darker brown shade, the following procedure with a vacuum slot was carried out.

A foamable composition was prepared by mixing 90.5 parts water, 1.5 parts Terasil Brown 3R (Disperse Brown 1), 0.45 parts Esterquinone Red BA-80% (Disperse Red 60), 0.05 parts Resolin Blue FBL (Disperse Blue 56), 3.5 parts Acrysol ASE-60, 0.5–0.75 parts ammonia (to pH 9.5–10) and 3.5 parts ammonium stearate (33% solution).

The composition was foamed to an 8:1 blow ratio and the foam was knife coated on four samples of the leisure twill fabric at 35 mils coating thickness.

Two samples were subjected to vacuuming from the back side using a vacuum slot and the wet pick-up was calculated at 29%. The samples were dried at 220° F. and steamed for color fixation at 250° F. for 45 min.

An additional two samples were vacuumed and padded at 30 psi and the wet pick-up was calculated as 35%. These two samples were also fixed by drying at 220° F. for 5 minutes and steaming at 250° F. for 45 minutes.

One sample from each set was rinsed, and displayed no color bleeding.

A darker brown shade was produced on each sample when compared to original shade, and all samples were uniformly dyed.

EXAMPLE 22

Developing Rapidogen Colors with Foamed Acid

A foamable composition containing acetic acid was prepared by mixing 94 parts water, 1 part Cellosize OP 52000 (hydroxyethyl cellulose thickener from Union Carbide), 2 parts glacial acetic acid and 3 parts Unamide N-72-3. The final pH was 4 and the viscosity was 3500 cps. (No. 6 spindle, 20 rpm at room temperature). The acetic acid composition was foamed using a kitchen mixer to blow ratio of 8:1.

Rapidogen color printed and dried fabric samples were knife coated with acid foam and processed as follows for the coupling reaction and development of color:

On one sample the acid foam was knife coated at 50 mils on the back side (unprinted side) and the fabric sample was padded at 30 psi. (wet pick-up was 25%).

On another sample the acid foam was knife coated at 100 mils on the back side and padded at 30 psi. (wet pick-up was 40%).

Both samples were batched for 20 minutes and then rinsed and soaped using 0.5% soda ash and 0.25% soap solution at 160° F. for 20 minutes. The samples were then rinsed and dried.

On both samples the rapidogen prints were found to be developed and to be comparable to acid aged samples.

What is claimed is:

1. In a foamable composition suitable for treating fabrics with a finishing agent comprising a fabric finishing agent in an amount effective to impart the properties of the finishing agent to a fabric, a foam stabilizer, and a liquid diluent; the improvement comprising about 0.5 to 8 percent foam stabilizer and in an amount sufficient to form said composition into a stable foam having a blow ratio in the range from about 2:1 to 20:1, a foam density in the range from about 0.5 gm/cc to 0.05 gm/cc, and which is sufficiently stable to substantially retain its characteristics during application until a mechanical force is applied thereto.

2. The composition of claim 1 wherein the fabric finishing agent is a material selected from the group consisting of coloring agents, color developers, water repellent agents, fire retardants, antistatic agents, soil release agents, durable press agents, and weighting agents.

3. The composition of claim 1 wherein the liquid diluent is selected from the group consisting of water, lower alkanols, chlorinated hydrocarbons and hydrocarbon solvents.

4. The composition of claim 1 wherein the pH is in the range from about 3 to 12.

5. The composition of claim 1 wherein the amount of finishing agent is from about 0.001 to 95 weight percent.

6. In a stable foamed composition suitable for continuously treating fabrics with a finishing agent comprising a fabric finishing agent in an amount effective to impart the properties of the finishing agent to a fabric, a foam stabilizer and a liquid diluent; the improvement comprising about 0.5 to 8 percent foam stabilizer and in an amount sufficient to form a stable foam having a flow ratio in the range from about 2:1 to 20:1, a foam density in the range from about 0.5 gm/cc to 0.05 gm/cc, and which is sufficiently stable so that upon application onto a fabric said foam composition will flow on the fabric surface and not break down until a mechanical force is applied thereto.

7. The composition of claim 6 wherein the foam stabilizer is selected from the group consisting of a metal salt of fatty acids, ammonium salts of fatty acids, sodium lauryl sulfate, coconut oil diethanol amide and disodium N-octadecyl sulfo succinamide.

8. The composition of claim 6 which further includes a thickener selected from the group consisting of polyacrylic acid, polyvinyl alcohol, natural gums and starches.

9. The composition of claim 7 which further includes a thickener selected from the group consisting of polyacrylic acid, polyvinyl alcohol, natural gums and starches.

10. The composition of claim 9 which further includes an auxiliary foam stabilizer selected from the group consisting of lauryl alcohol, sodium laurate and lauric acid.

11. The composition of claim 6 further including an auxiliary foam stabilizer selected from the group consisting of lauryl alcohol, sodium laurate and lauric acid.

12. The composition of claim 6 wherein the liquid diluent is selected from the group consisting of water, lower alkanols, chlorinated hydrocarbons and hydrocarbon solvents.

13. The composition of claim 6 wherein the pH is in the range from about 3 to 12.

14. The composition of claim 6 wherein the amount of finishing agent is from about 0.001 to 95 weight percent.

* * * * *

REEXAMINATION CERTIFICATE (172nd)

United States Patent [19]

Gregorian et al.

[11] B1 4,266,976

[45] Certificate Issued Mar. 6, 1984

[54] FABRIC TREATING COMPOSITIONS

[75] Inventors: Razmic S. Gregorian, Aiken; Chettoor G. Namboodri, North Augusta, both of S.C.

[73] Assignee: United Merchants and Manufacturers, Inc., New York, N.Y.

Reexamination Request:
No. 90/000,270, Oct. 4, 1982

Reexamination Certificate for:

| | |
|---|---|
| Patent No.: | **4,266,976** |
| Issued: | **May 12, 1981** |
| Appl. No.: | **15,030** |
| Filed: | **Feb. 26, 1979** |

Related U.S. Application Data

[60] Continuation of Ser. No. 794,627, May 6, 1977, abandoned, which is a division of Ser. No. 584,389, Jun. 6, 1975, Pat. No. 4,118,526.

[51] Int. Cl.[3] ..... C09K 3/18

[52] U.S. Cl. ..... 106/2; 8/477; 106/15.05; 252/3; 252/8.05; 252/307

[58] Field of Search ..... 106/2, 15.05; 252/3, 252/8.05, 307, 350, 608, 610; 8/477

[56] References Cited

U.S. PATENT DOCUMENTS

| | | | |
|---|---|---|---|
| 3,762,860 | 10/1973 | Abrahams et al. | 8/21 A |
| 3,822,145 | 7/1974 | Liebowitz et al. | 427/242 |
| 4,242,377 | 12/1980 | Roberts et al. | 427/242 |

*Primary Examiner*—Lorenzo B. Hayes

[57] ABSTRACT

Foamable fabric treatment compositions are disclosed which are composed of a fabric finishing agent and a foam stabilizer, which compositions are capable of forming a foam having a blow ratio in the range from about 2:1 to 20:1 and a foam density range from about 0.5 gm/cc to 0.05 gm/cc. Methods for preparing and using the foamable compositions are disclosed.

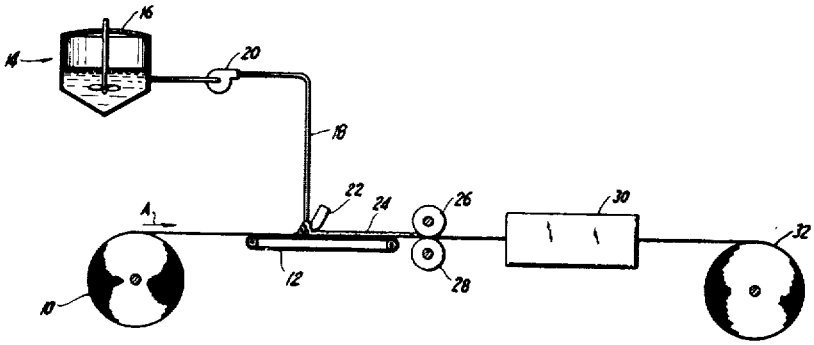

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

The patentability of claims 1–14 is confirmed.

* * * * *